US006402246B1

(12) United States Patent
Mundell

(10) Patent No.: US 6,402,246 B1
(45) Date of Patent: Jun. 11, 2002

(54) SIMPLIFIED STRAP LUMBAR SUPPORT DEVICE

(75) Inventor: Donald David Mundell, Carthage, MO (US)

(73) Assignee: L&P Property Management, South Gate, CA (US)

( * ) Notice: Subject to any disclaimer, the term of this patent is extended or adjusted under 35 U.S.C. 154(b) by 0 days.

(21) Appl. No.: 09/832,692

(22) Filed: Apr. 11, 2001

(51) Int. Cl.[7] ..... A47C 7/46
(52) U.S. Cl. ..... 297/284.4
(58) Field of Search ..... 297/284.1, 284.4

(56) References Cited

U.S. PATENT DOCUMENTS

| | | | | |
|---|---|---|---|---|
| 1,182,854 A | | 5/1916 | Poler | |
| 2,614,615 A | | 10/1952 | Asaro | |
| 2,835,312 A | | 5/1958 | Neely | |
| 2,936,824 A | | 5/1960 | Neely | |
| 3,095,188 A | * | 6/1963 | Giese | 297/284.4 |
| 3,241,879 A | | 3/1966 | Castello et al. | 297/284.4 |
| 3,378,299 A | | 4/1968 | Sandor | 297/284.4 |
| 4,019,777 A | | 4/1977 | Hayashi | |
| 4,162,807 A | | 7/1979 | Yoshimura | |
| 4,296,965 A | | 10/1981 | Sakurada et al. | |
| 4,565,406 A | | 1/1986 | Suzuki | |
| 4,588,172 A | | 5/1986 | Fourrey et al. | 297/284.4 |
| 4,627,661 A | | 12/1986 | Bonnhult et al. | |
| 4,715,653 A | | 12/1987 | Hattori et al. | 297/284.4 |
| 5,022,709 A | | 6/1991 | Marchino | |
| 5,335,965 A | | 8/1994 | Sessini | 297/284.4 |
| 5,468,048 A | | 11/1995 | Clemens et al. | 297/284.4 |
| 5,823,620 A | | 10/1998 | Le Caz | 297/284.4 |
| 5,954,399 A | * | 9/1999 | Hong | 297/284.4 |

FOREIGN PATENT DOCUMENTS

GB 2 013 487 A 8/1979

* cited by examiner

*Primary Examiner*—Peter R. Brown
(74) *Attorney, Agent, or Firm*—Thompson Colburn LLP; Grant D. Kang; Dennis J M Donahue, III

(57) ABSTRACT

A lumbar support device has a seat frame, a pair of brackets connected to the seat frame, a spring assembly connected to the pair of brackets in such a manner as to form a center section traversing the seat frame and a pair of cantilevered ends on opposite sides of the center section, and an actuator assembly operatively connecting the cantilevered ends. The pair of brackets respectively provide a pair of fulcrums about which the cantilevered ends can rotate. In operation, the actuator assembly moves the cantilevered ends of the spring assembly to bow the center portion. The lumbar support device may also have a single cantilevered end.

24 Claims, 3 Drawing Sheets

SIMPLIFIED STRAP LUMBAR SUPPORT DEVICE

CROSS-REFERENCE TO RELATED APPLICATION

Not Applicable.

STATEMENT REGARDING FEDERLLY SPONSORED RESEARCH OR DEVELOPMENT

Not Applicable.

FIELD OF THE INVENTION

The present invention relates generally to lumbar support devices. More particularly, the present invention relates to lumbar support devices that are capable of changing shape, especially curvature in the lumbar region.

BACKGROUND OF THE INVENTION

Lumbar support devices have been integrated into seats to change their shape, thereby allowing each occupant to adjust the support provided by the seat. The curvature of these devices is traditionally adjustable so that an occupant can operate the device to push the seat forward towards the occupant's spinal column in the lumbar region. It is generally known to change the curvature of a lumbar support device using an actuator assembly that moves a support structure, such as a sinusoidal spring element. It is also well known to provide an actuator assembly that is either manually operated, using a handle or knob, or power assisted, using a drive motor and control switches. Increased curvature is usually accomplished by moving the support structure forward into the lumbar region, rotating sections of the support structure into the lumbar region, or bowing the support structure out into the lumbar region.

SUMMARY OF THE INVENTION

The present invention is a strap lumbar device having a seat frame, a pair of brackets connected to the seat frame, a spring assembly connected to the pair of brackets in such a manner as to form a center section traversing the seat frame and a pair of cantilevered ends on opposite sides of the center section, and an actuator assembly operatively connecting the cantilevered ends. The pair of brackets respectively provide a pair of fulcrums about which the cantilevered ends can rotate.

In the preferred embodiment, the spring assembly has two integrally-formed, sinusoidal spring elements attached by a connector, and the center section of the spring assembly has a recessed portion. In other embodiments of the invention, a single sinusoidal spring has only one cantilevered end that rotates about a bracket, and a leaf spring is cantilevered about a pair of coil springs. The lumbar support device can be oriented horizontally or vertically in the seat frame, and the orientation of the cantilevered ends can be reversed.

In operation, the fulcrums allow the cantilevered ends to function as levers. The actuator assembly moves the levers which rotate about the fulcrums and bow the center section. The fulcrums are located between the distal end of the levers and the center section of the spring to stop the lever from sliding in the bracket and force the lever to rotate about the bracket.

It is a purpose of the present invention to provide a lumbar support device that is simple and affordable to manufacture.

It is a further purpose of the present invention to provide a mechanically simplified lumbar support device that has a thin profile when flat.

Further advantages of the present invention will be apparent from the description below with reference to the accompanying drawings in which like numbers indicate like elements.

DETAILED DESCRIPTION OF THE INVENTION

Figure 1:
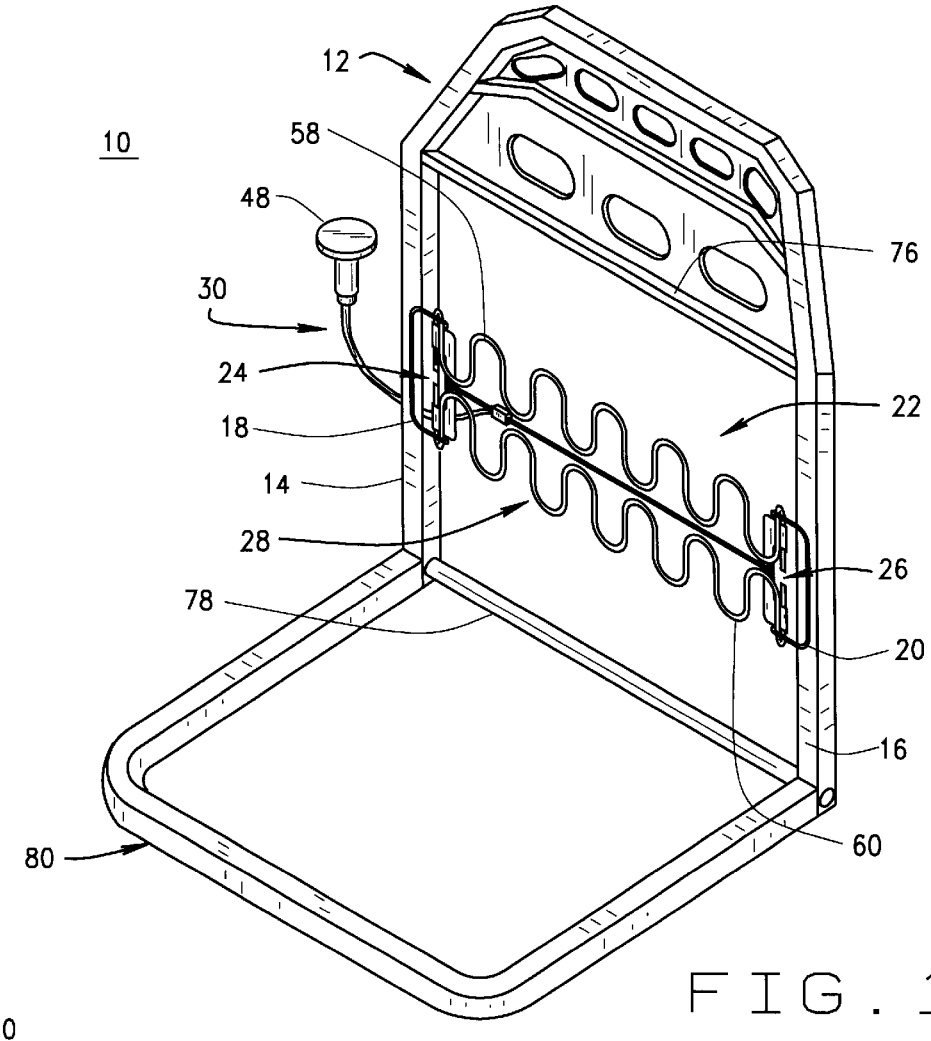
FIG. 1 illustrates the preferred embodiment of the lumbar support device installed in a frame.
Figure 2:
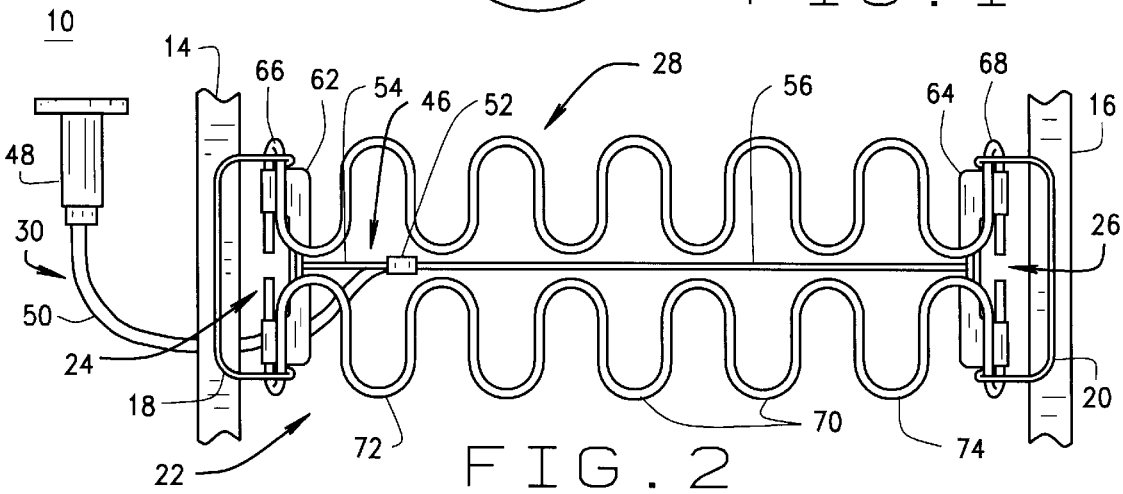
FIG. 2 illustrates a front view of the preferred embodiment of the lumbar support device.
Figure 3:
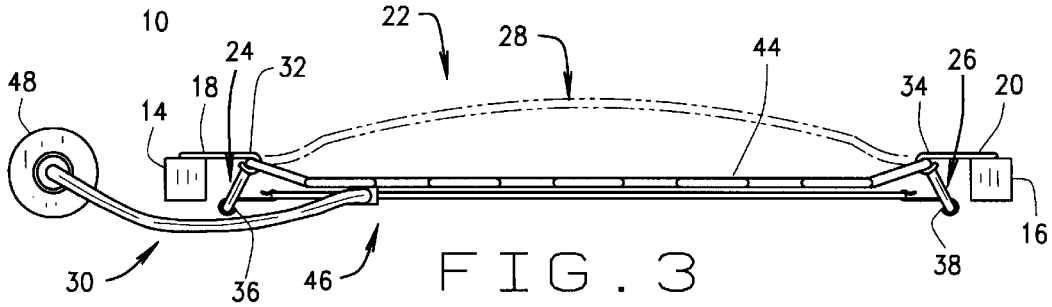
FIG. 3 illustrates a top view of the preferred embodiment of the lumbar support device.

As shown in FIGS. 1, 2 and 3, the preferred embodiment of a lumbar support device 10 generally includes a seat frame 12 having a first side 14 and a second side 16, a first bracket 18 and a second bracket 20 respectively fixed to the first and second sides 14, 16, a spring assembly 22 connected to the pair of brackets 18, 20 in such a manner as to respectively form first and second cantilevered ends 24, 26 on opposite sides of a center section 28, and an actuator assembly 30 operatively connecting the cantilevered ends 24, 26. The first and second brackets have first and second fulcrums 32, 34, respectively. The first fulcrum 32 is located proximately to the first side 14 and located distally from the second side 16, and the second fulcrum 34 is located proximately to the second side 16 and located distally from the first side 14.

In the preferred embodiment, the center section 28 of the spring assembly 22 is integrally formed with the first and second cantilevered ends 24, 26. The first and second cantilevered ends 24, 26 are rotatably connected to and cantilevered about the first and second brackets 18, 20, respectively, and the center section 28 traverses the seat frame between the first and second brackets 18, 20. The first and second cantilevered ends 24, 26 have first and second distal ends 36, 38, respectively, such that the first and second cantilevered ends 24, 26 define first and second levers 40, 42, respectively. The first lever 40 extends from the first fulcrum 32 to the first distal end 36, and the second lever 42extends from the second fulcrum 34 to the second distal end 38. The actuator assembly 30 connects the first and second distal ends 36, 38 and operates to force the distal ends 36, 38 of the respective levers 40, 42 toward each other, thereby rotating the levers 40, 42 about the first and second fulcrums 32, 34, respectively, and bowing the center section 28. In the drawings, broken lines illustrate the actuated position.

The center section 28 has a recessed portion 44 that reduces the thickness 46 of the center section 28 when not bowed. The brackets 18, 20 are rigidly attached to the seat frame 12 and the cantilevered ends 24, 26 are attached to their respective fulcrums 18, 20 such that they are only able to rotate. The fulcrums 18, 20 stop the respective cantilevered ends 24, 26 from sliding. Without the recessed portion 44, a straight center section (see FIGS. 5 & 6) would have the same length as a straight line between the brackets 18, 20 and forcing curvature in the straight center section would bow the center section, requiring the center section to extend and requiring the actuator assembly to provide additional force to produce both curvature and extension. With the recessed portion 44, the center section 28 has a greater length than the straight line between the brackets. Therefore, the recessed portion 44 reduces the force needed by the actuator assembly 30 to bow the center section 28 because less force, if any, is necessary to extend the center section 28.

The actuator assembly 30 preferably includes a bowden cable assembly 46 and an actuator 48. The bowden cable assembly 46 has a sheathed section 50, a base 52, a rod 54 and an unsheathed section 56. The rod 54 and the unsheathed section 56 respectively link the distal ends 36, 38 of the levers 40, 42. The base 52 holds the rod 54 and one end of the sheathed section 50, and the other end of the sheathed section 50 is connected to the actuator 48. To force the distal ends 36, 38 of the respective levers 40, 42 toward each other, the actuator 48 transmits a tractive force through the bowden cable assembly 46 to the distal ends 36, 38. Although the preferred embodiment uses the tractive actuator assembly 30, other types of actuator assemblies, including those supplying pulsive forces may also be used. For example, as one type of pulsive actuator assembly, screw actuators (not shown) could engage threaded rods (not shown) to push the distal ends 36, 38 of the respective levers 40, 42 toward each other.

Figure 4:
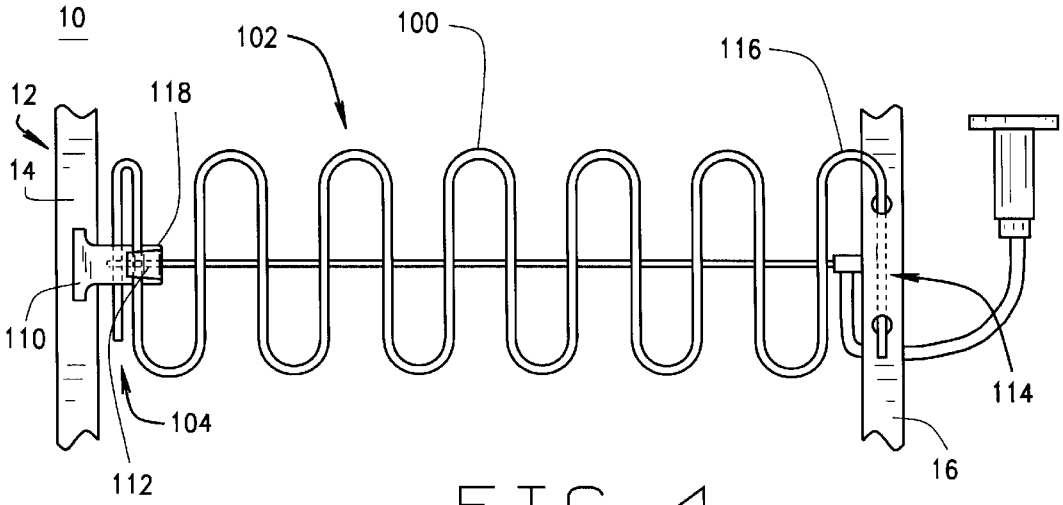
FIG. 4 illustrates a front view of a first alternative embodiment of the lumbar support device according to the present invention.
Figure 5:
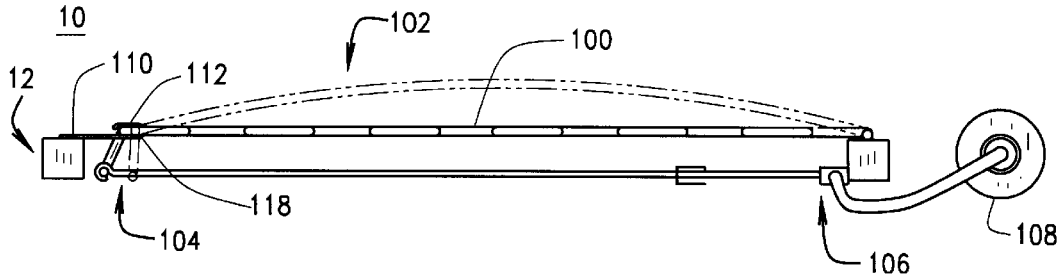
FIG. 5 illustrates a top view of the first alternative embodiment of the lumbar support device illustrated in FIG. 4.
Figure 6:
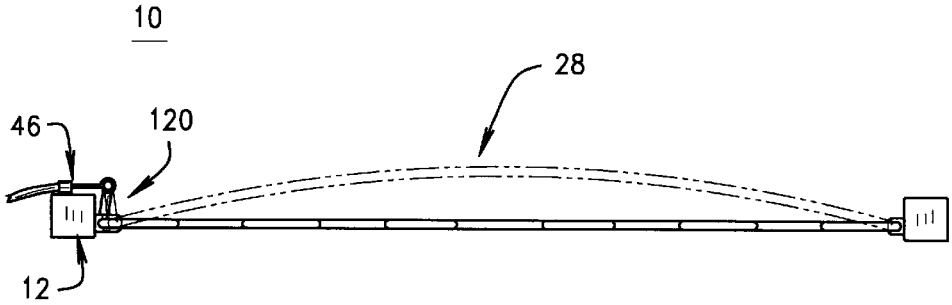
FIG. 6 illustrates a second alternative embodiment of the lumbar support device according to the present invention.

The spring assembly 22 is preferably formed from a pair of sinusoidal springs 58, 60 that are similarly attached to the brackets 18, 20. For each of the sinusoidal springs 58, 60, the center section 28 is integrally formed with the cantilevered ends 24, 26 from a single wire bent into the sinuous shape. The springs 58, 60 are held together by a pair of connectors 62, 64, but according to the present invention, either one of the pair, sinusoidal spring 58 or sinusoidal spring 60, could be used alone, as illustrated in FIGS. 4, 5 and 6. In the preferred embodiment, a first loop 66 is rotatably connected to and cantilevered about the first bracket 18, thereby defining the first cantilevered end 24, and a last loop 68 is rotatably connected to and cantilevered about the second bracket 20, thereby defining the second cantilevered end 26. The center section 28 has a plurality of loops 70 between the pair of brackets 18, 20, including a second loop 72 integrally formed with the first loop 66 and a second-to-last loop 74 integrally formed with the last loop 68.

As illustrated in the preferred embodiment, the first side 14 is generally opposite the second side 16, the first side 14 being on the right side of the seat frame 12 and the second side 16 being on the left side of the seat frame 12. The seat frame 12 also has a top side 76 and a bottom side 78 that can alternatively be used as the first side 14 and the second side 16, respectively. The present invention can also be mounted in reverse orientations, and the present invention may be attached to the bottom portion 80 of the seat frame 12.

As illustrated in FIGS. 1, 2 and 3, the first and second brackets 18, 20 are directly and rigidly attached to the first and second sides 14, 16, respectively. Such a fixed connection can be made by welding the brackets to the seat frame, by mounting the brackets with hardware, by integrally forming the brackets in the seat frame, or by using other methods to make a direct, rigid connection. Additionally, the connection between the brackets 18, 20 and the seat frame 12 does not necessarily need to be direct or rigid. An example of an indirect connection would be where an additional structural element is interposed between the brackets 18, 20 and the seat frame 12, such as a coil spring (not shown), in which case the connection would neither be direct nor rigid. Alternatively, the brackets 18, 20 may be directly connected to the seat frame 12 and the coil springs may be interposed between the fulcrums 32, 34 and the respective levers 40, 42. An example of a direct connection that is not rigid could be a rod having a loop (not shown) rotatably attached to the seat frame, such as the fulcrums 32, 34 of the brackets 18, 20, or a coil spring attached at one end to the seat frame and attached at its opposite end to the lever (see FIG. 7). Finally, the brackets can traverse the seat frame 12 in a direction substantially perpendicular to the center section 28 and still provide first and second fulcrums 32, 34 that are proximate and distal from the respective sides 14, 16. For example, in the configuration where the center section 28 horizontally traverses (between left and right) the seat frame 12, the brackets can be a pair of generally parallel rods (not shown) on opposite sides of the frame that are attached to the frame at the top side and the bottom side. With such a configuration, the rod traversing the frame on the left side could provide a fulcrum proximate to the left side and the rod traversing the frame on the right side could provide a fulcrum proximate to the right side.

An alternative embodiment of the lumbar support device 10 is illustrated in FIGS. 4 and 5. A sinusoidal spring 100 is similar to the spring assembly 22 described in the preferred embodiment, but the center section 102 traverses straight across the seat frame 12 without any recessed portion. The spring 100 only has one lever 104 at the first side 14 of the seat frame 12, and a bowden cable assembly 106 connects the lever 104 with an actuator 108. A bracket 110 is rigidly attached to the seat frame 12 at the first side 14. The bracket 110 has a hook 112 to hold the lever 104, thereby allowing the lever 104 to slide somewhat as well as rotate in the hook 112. An integral bracket 114 is formed in the second side 16 of the seat frame 12, and the second end 116 of the spring 100 is rotatably attached to the integral bracket 114.

As discussed above, without any recessed portion, the center section 102 has the same length as a straight line between the brackets 110, 116. The bracket 110 with the hook 112 allows the actuator 108 to bow the center section 102 with less force than would be necessary if the lever 104 is only permitted to rotate. For example, replacing the bracket 110 with a bracket with a loop, as shown in the preferred embodiment, would prevent the lever 104 from any sliding or translation, and the actuator 108 would force both curvature and extension in the center section 102. Although the lever 104 is allowed to slide in the bracket 114, sliding is limited because the bracket 114 has a fulcrum 118 that stops the lever 104 from sliding and forces the lever 104 to rotate.

Figure 7:
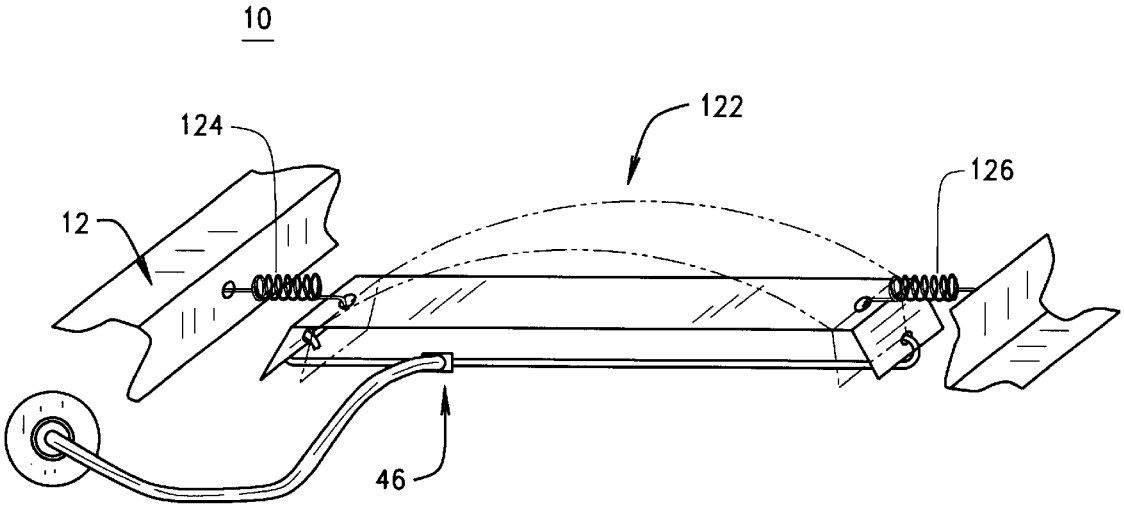
FIG. 7 illustrates a third alternative embodiment of the lumbar support device according to the present invention.

FIGS. 6 and 7 illustrate other alternative embodiments of the present invention for the lumbar support device 10. FIG. 6 shows a lever 120 that is oriented opposite from the other embodiments. As with any of the embodiments, if the spring is formed with a curvature shape, the lever can be used in reverse to flatten the spring, in which case a tractive actuator assembly could be replaced with a pulsive actuator assembly and vice-versa. FIG. 7 shows a leaf spring 122 connected to the seat frame 12 through a pair of coil springs 124, 126 which serve as brackets. Although the preferred embodiment illustrated in FIGS. 1, 2 and 3 has a spring assembly 22 with pair of sinusoidal springs 58, 60 and a pair of cantilevered ends 24, 26, it is evident from the alternative embodiments that the lumbar support device 10 may have a single spring and a single cantilevered end, and that different types of springs will work. In each embodiment of the lumbar support device 10, including the preferred embodiment, every fulcrum is located between the distal end of the lever and the center section of the spring.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while a sinusoidal spring and a leaf spring are particularly illustrated for the present invention, it will be evident to those skilled in the art that other types of integrally formed springs or combination of springs, such as a composite spring made with a leaf spring and a sinusoidal spring, or a combination using a coil spring, may be interchanged with the illustrated springs. Thus, the breadth and scope of the present invention should not be limited by any of the above-described exemplary embodiments, but should be defined only in accordance with the following claims appended hereto and their equivalents.

What is claimed is:

1. A lumbar support device, comprising:

a first bracket having a first fulcrum;

a second bracket located distally from said first bracket;

a first spring having a first cantilevered end, a second end and a center section integrally formed with said first cantilevered end and said second end, said first cantilevered end rotatably connected to and cantilevered about said first bracket, said second end connected to said second bracket, and said center section traversing between said first bracket and said second bracket, wherein said first cantilevered end defines a first lever extending from said first fulcrum to a first distal end such that said first fulcrum is located between said first distal end and said center section;

an actuator assembly operatively connected to said first distal end of said first lever, wherein said actuator assembly moves said first distal end and said first fulcrum stops said first lever from sliding and forces said first lever to rotate.

2. A lumbar support device according to claim 1, further comprising a seat frame having a first side for attaching said first bracket and a second side for attaching said second bracket.

3. A lumbar support device according to claim 2 wherein said first bracket is integrally formed with said first side of said seat frame.

4. A lumbar support device according to claim 1 wherein said first spring is a sinusoidal spring.

5. A lumbar support device according to claim 1 wherein said first spring is a leaf spring.

6. A lumbar support device according to claim 1 wherein said first fulcrum of said first bracket is a hook limiting said lever from sliding.

7. A lumbar support device according to claim 1 wherein said first fulcrum of said first bracket is a loop preventing said lever from sliding.

8. A lumbar support device according to claim 1 wherein said first bracket further comprises a coil spring.

9. A lumbar support device according to claim 1 wherein said actuator assembly tractively moves said first distal end.

10. A lumbar support device according to claim 1 wherein said actuator assembly pulsively moves said first distal end.

11. A lumbar support device according to claim 1 wherein said second bracket further comprises a second fulcrum and said second end is rotatably connected to and cantilevered about said second bracket, said second end defining a second lever extending from said second fulcrum to a second distal end, and wherein said actuator assembly operatively connects said first distal end with said second distal end.

12. A lumbar support device according to claim 1, further comprising a second spring and a pair of connectors, said pair of connectors attaching said first spring with said second spring.

13. A lumbar support device according to claim 1 wherein said center section is further comprised of a recessed portion.

14. A lumbar support device, comprising:

a first bracket having a first fulcrum;

a second bracket located distally from said first bracket;

a spring assembly having a first cantilevered end, a second end, and a center section fixedly attached to said first cantilevered end and said second end, said first cantilevered end rotatably connected to and cantilevered about said first bracket, said second end connected to said second bracket, and said center section extending between said first cantilevered end and said second end, wherein said first cantilevered end defines a first lever extending from said first fulcrum to a first distal end such that said first fulcrum is located between said first distal end and said center section; and an actuator assembly operatively connected to said first distal end of said first lever, wherein said actuator assembly moves said first distal end and said first fulcrum stops is first lever from sliding and forces said first lever to rotate.

15. A lumbar support device according to claim 14, further comprising a seat frame having a first side for attaching said first bracket and a second side for attaching said se nd bracket.

16. A lumbar support device according to claim 14, wherein said actuator assemble pulsively moves said first distal end.

17. A lumbar support device according to claim 14 wherein said second bracket further comprises a second fulcrum and said second end is rotatably connected to and cantilevered about said second bracket, said second end defining a second lever having a second lever arm extending from said second fulcrum to a second distal end, and wherein said actuator assembly operatively connects said first distal end with said second distal end.

18. A lumbar support device according to claim 14, wherein said center section is further comprised of a recessed portion.

19. A lumbar support device, comprising:

first bracket having a first fulcrum;

a second bracket having a second fulcrum, said second bracket located distally from said first bracket;

a spring assembly having a first cantilevered end, a second cantilevered end, and a center section integrally formed with said first cantilevered end and said second cantilevered end, said first cantilevered end rotatably connected to and cantilevered about said first bracket, said second cantilevered end rotatably connected to and cantilevered about said second bracket, and said center section extending between said first bracket and said second bracket, wherein said first cantilevered end defines a first lever extending from said first fulcrum to a first distal end such that said first fulcrum is located between said first distal end and said center section and wherein said second cantilevered end defines a second lever extending from said second fulcrum to a second distal end such that said second fulcrum is located between said second distal end and said center section; and an actuator assembly operatively connecting said first distal end with said second distal end, wherein said actuator assembly moves said first distal end and said second distal end and said first fulcrum and said second fulcrum respectively stop said first lever and said second lever from sliding and respectively force said first lever and said second lever to rotate.

20. A lumbar support device according to claim 19 wherein said center section of said spring assembly is further comprised of a recessed portion.

21. A lumbar support device according to claim 19 wherein said actuator assembly further comprises a bowden cable assembly and an actuator, said actuator operatively engaging said bowden cable assembly and said bowden cable assembly tractively linking said first distal end with said second distal end.

22. A lumbar support device according to claim 19, further comprising a seat frame having a first side for attaching said first bracket and a second side for attaching said second bracket.

23. A lumbar support device according to claim 19 wherein said spring assembly is further comprised of a sinusoidal spring having a first loop, a last loop and a plurality of loops, said first loop defining said first cantilevered end, said last loop defining said second cantilevered end, and said plurality of loops defining said center section.

24. A lumbar support device according to claim 19 wherein said plurality of loops is further comprised of a second loop and a second-to-last loop, said second loop being integrally formed with said first loop and said second-to-last loop being integrally formed with said last loop.

* * * * *

UNITED STATES PATENT AND TRADEMARK OFFICE

CERTIFICATE OF CORRECTION

PATENT NO. : 6,402,246 B1
DATED : June 11, 2002
INVENTOR(S) : Donald David Mundell It is certified that error appears in the above-identified patent and that said Letters Patent is hereby corrected as shown below:

Column 2,
Line 55, “42extends” should be -- 42 extends --

Column 6,
Line 36, “se nd” should be -- second --
Line 52, “first bracket” should be -- a first bracket --

Column 8,
Line 13, “according to claim 19” should be -- according to claim 23 --

Signed and Sealed this

First Day of April, 2003

JAMES E. ROGAN
*Director of the United States Patent and Trademark Office*